US007739856B2

(12) United States Patent
Cash, III

(10) Patent No.: US 7,739,856 B2
(45) Date of Patent: Jun. 22, 2010

(54) PACKAGING MACHINE WITH GLUING STATION AND FOLDING STATION

(75) Inventor: John W. Cash, III, Dallas, GA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 190 days.

(21) Appl. No.: 12/101,817

(22) Filed: Apr. 11, 2008

(65) Prior Publication Data

US 2008/0254961 A1 Oct. 16, 2008

Related U.S. Application Data

(60) Provisional application No. 60/911,222, filed on Apr. 11, 2007.

(51) Int. Cl.
*B65B 7/20* (2006.01)

(52) U.S. Cl. ..... 53/376.5; 53/382.1; 53/387.1; 493/128; 493/150; 493/183

(58) Field of Classification Search ..... 53/376.5, 53/377.4, 382.1, 383.1, 387.1; 493/128, 493/150, 151, 183

See application file for complete search history.

(56) References Cited

U.S. PATENT DOCUMENTS

| | | | | |
|---|---|---|---|---|
| 4,480,421 | A | 11/1984 | Rece | |
| 5,131,207 | A * | 7/1992 | Wischusen et al. | 53/252 |
| 5,188,695 | A * | 2/1993 | Colton | 156/356 |
| 5,379,573 | A | 1/1995 | Greenwell | |
| 5,595,043 | A * | 1/1997 | Radigan | 53/201 |
| 5,605,027 | A | 2/1997 | Scroggin et al. | |
| 6,012,503 | A * | 1/2000 | Balder | 156/578 |
| 6,413,315 | B1 * | 7/2002 | Hendricks | 118/222 |
| 6,622,461 | B2 * | 9/2003 | Gambetti | 53/491 |
| 7,517,307 | B2 * | 4/2009 | Pokusa et al. | 493/128 |

* cited by examiner

*Primary Examiner*—Hemant M Desai
(74) *Attorney, Agent, or Firm*—Karen L. Ware

(57) ABSTRACT

An apparatus for forming an end closure structure of a carton. The end closure structure is formed from minor end flaps and major end flaps. The apparatus includes a carton conveyor for transferring the carton in a flow direction along a carton conveyor path, a major end flap retaining guide assembly for retaining the major end flaps in an outwardly upright position, a minor end flap retaining guide assembly for retaining the minor end flaps in an inwardly folded position, and a gluing station for applying adhesive to the major and minor end flaps.

7 Claims, 8 Drawing Sheets

PACKAGING MACHINE WITH GLUING STATION AND FOLDING STATION

CROSS REFERENCE TO RELATED APPLICATIONS

This application claims priority to U.S. Provisional Application No. 60/911,222 filed Apr. 11, 2007, the entirety of which is incorporated herein by reference.

TECHNICAL FIELD

This invention relates generally to packaging machinery and systems and, more specifically, to a packaging machine with a gluing station and a folding station that are each adjustable to enable the packaging machine to changeover to package various types of cartons.

BACKGROUND

Machines for packaging products, such as soda cans or bottles, in paperboard cartons are well known in the art. The packaging machine separates the products into groups and transports the groups adjacent to a carton conveyor where a loading mechanism pushes the groups of products into open ends of cartons that are configured as tubular structures. Thereafter, as the loaded cartons are transported along the carton conveyor path, adhesive such as hot glue: can be applied to end flaps of each carton. The end flaps are then folded and secured to one another and each packed and closed carton can then be shipped for retail sale.

Packaging machines generally do not have the flexibility to "changeover," that is to be reconfigured to package cartons that vary in size or that are folded according to different folding procedures. Given the size, cost, and complexity of these machines, this lack of versatility is expensive. Therefore, it is advantageous to design machines which are as adaptable as possible.

Designing such versatile packaging machines poses many challenges. At the very least, these machines must successfully load and construct a carton while operating under steady state conditions in which cartons continuously travel through the packaging machine on a carton conveyor or belt conveyor. It is also desired that the packaging machines are able to finish loading and sealing certain partially erected cartons when the carton conveyor is stopped. The carton conveyor may be stopped, for example, at end of a worker's shift, at the end of a work day, or because of trouble along the carton conveyor path, such as due to a misfed carton. Conveyor stoppage is referred to herein as either a cycle stop or an emergency stop (e-stop). In each of these instances, some cartons remaining along the carton conveyor path have had glue applied to their end flaps, but have not had their end flaps folded and secured together. The glue can cool or cure before the conveyor is restarted and, thus, when the conveyor is restarted, folding and pressing the end flaps of these cartons together will not cause the end flaps to be secured to one another and the carton construction is unsuccessful. A versatile carton packaging machine design, therefore, functions to complete the construction of loaded packages during a cycle stop or an e-stop and to be adaptable to accommodate various carton configurations.

SUMMARY

The various embodiments of the present invention overcome the shortcomings of the prior art by providing an apparatus for use with a packaging machine. The apparatus is versatile in that it is capable of forming the end closure structure of different sizes of cartons and according to different folding procedures. Further, the apparatus can accommodate such cartons during a cycle stop or emergency stop.

According to an exemplary embodiment, an apparatus for forming an end closure structure of a carton that travels in a flow direction along a carton conveyor path, the end closure structure being formed from minor end flaps and major end flaps, includes a carton conveyor for transferring the carton in a flow direction along a carton conveyor path, a major end flap retaining guide assembly for retaining the major end flaps in an outwardly upright position, a minor end flap retaining guide assembly for retaining the minor end flaps in an inwardly folded position, a gluing station for applying adhesive to the major and minor end flaps, and a folding station. The gluing station includes a vertical support member and a glue gun that is positionable along the length of the vertical support member.

According to one aspect of the invention, the glue gun is positionable above a top wall of the tubular carton. According to another aspect of the invention, the glue gun is positionable below a bottom wall of the tubular carton.

In certain embodiments, the apparatus further includes a controller for activating or deactivating the glue gun according to a selected folding sequence.

According to one aspect of the invention, an exemplary automated method of closing a tubular carton at least a major end flap and a minor end flap includes retaining the minor end flap in an inwardly folded position, retaining the at least one major end flap in an outwardly upright position, transferring the carton along a carton conveyor path in a flow direction, and applying glue with a glue gun to at least one of the major and minor end flaps while the carton is being transferred in the flow direction.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

General Description of Apparatus and Process

Figure 8:
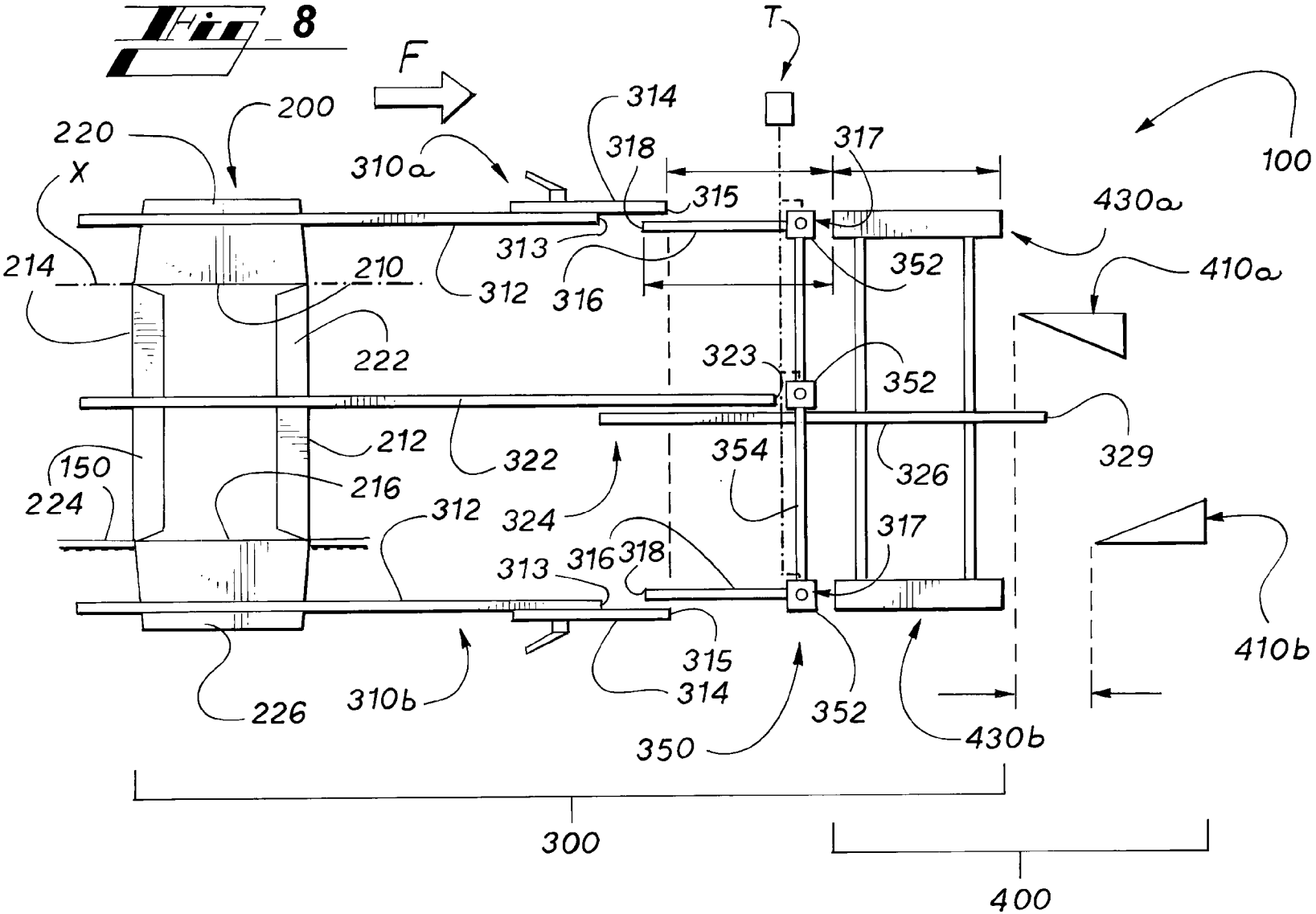
FIG. 8 is a partial operator side elevation view of the packaging machine of FIGS. 1-4.

Referring now to the drawings, wherein like numerals indicate like elements throughout the several views, the drawings illustrate certain of the various aspects of exemplary embodiments of an apparatus that can be used in cooperation with other elements or modules of a packaging machine to package cartons. The apparatus can changeover to package various types of cartons. FIGS. 1-4 and 8 illustrate a first exemplary embodiment of an apparatus 100 that operates to form end closure structures (each typically formed from one or more end flaps) to enclose the open ends of tubular cartons 200. The apparatus 100 includes a carton conveyor 150, an end flap retaining guide assembly 300, a gluing station 350, and a folding station 400 and is reconfigurable to accommodate cartons 200 of various sizes and/or to fold the end flaps of cartons 200 according to various folding sequences. It should be understood that FIG. 8 is a conceptual illustration that is provided to illustrate the arrangement of the elements of the apparatus 100. In the drawings, certain elements may be omitted such that other elements are made visible. Further, certain elements may be represented differently although they are functionally similar.

Initially, each tubular carton 200 is configured as-tubular structure having open ends and is disposed on the carton conveyor 150 (FIGS. 1 and 8) that transports each carton 200 along a carton conveyor path X in a flow direction F. Products or articles (not shown) are then loaded through one or both of the open ends of each carton 200 by a loading mechanism (not shown). Thereafter, as described in further detail below, glue is applied to the end flaps of each carton 200 at the gluing station 350 and the end flaps are folded and secured to one another at the folding station 400 to package the articles in the cartons 200.

It should be noted that the exemplary apparatus 100 is arranged to include a single gluing station 350 and a single folding station 400. Thus, glue is applied to the end flaps of the carton 200 at selected locations and, thereafter, the folding steps are accomplished. In alternative embodiments, for example, the embodiment illustrated in FIG. 10 and described in further detail below, a second exemplary embodiment of a packaging machine is alternatively arranged to include a plurality of gluing stations and a plurality of folding stations. Thus, a portion of the gluing and folding operations is accomplished by a first set of gluing and folding stations and additional gluing and folding operations are accomplished by a second set of gluing and folding stations. Each of these packaging machine arrangements are described in further detail below.

Definitions

The terms "upstream", "downstream", "trailing", and "leading" are used herein with respect to the flow direction F and to the carton conveyor path X. The terms can be used to describe the direction of movement of elements or the relative position of elements with respect to one another. Specifically, the terms "upstream" and "downstream" can refer to elements having fixed positions, for example, where a downstream element is positioned at a distance in the flow direction F from an upstream element. Downstream movement is movement in the flow direction F and upstream movement is movement opposite the flow direction F. Further, the terms "leading" and "trailing" can refer to elements that are moving in the flow direction F, for example, where the leading element is further along the carton conveyor path X in the flow direction F than the trailing element.

The terms "longitudinal" and "transverse" are used herein to describe movement or alignment with respect to the carton conveyor path X. Specifically, the term longitudinal can be used to describe movement or alignment that is substantially parallel with the carton conveyor path X and the term transverse can be used to describe movement or alignment that is substantially perpendicular to the carton conveyor path X.

The terms "operator side" and "carton side" are used to distinguish opposing sides of the apparatus. Articles are typically loaded into cartons moving from operator side to carton side. The carton side is-the side along which cartons 200 are conveyed on the carton conveyor 150.

Description of Carton

Upstream of the gluing station 350 and the folding station 400, each carton 200, an end of which is shown in FIGS. 1-4, is configured as a tubular structure with opposed open ends. The tubular structure is provided by a top wall 210, a leading side wall 212, a trailing side wall 214, and a bottom wall 216. End flaps are hingedly connected to opposite ends of each of the walls of the tubular structure (only one set of end flaps is visible in FIGS. 1-5). Top end flaps 220 are hingedly connected to the top wall 210, leading side end flaps 222 are hingedly connected to the leading side wall 212, trailing side end flaps 224 are hingedly connected to the trailing side wall 214, and bottom end flaps 226 are hingedly connected to the bottom wall 216. For simplicity, the top and bottom end flaps 220, 226 are referred to hereinafter as major end flaps 220, 226 and the side end flaps 222, 224 are referred to hereinafter as minor end flaps 222, 224 unless the end flaps are referenced individually.

End Flap Retaining Guide Assembly

Referring to FIGS. 1-4, the end flap retaining guide assembly 300 includes upper and lower major end flap retaining guide assemblies 310*a*, 310*b* and a minor end flap retaining guide assembly 320, each of which extend longitudinally along a portion of the length of the carton conveyor path X to retain the major end flaps 220, 226 and the minor end flaps 222, 224 of each carton 200 in folded positions as each carton 200 travels in the flow direction F. Specifically, the upper and lower major end flap retaining guide assemblies 310*a*, 310*b* retain the major end flaps 220, 226, respectively, in outwardly upright folded positions (substantially vertical) until the trailing edges of the major end flaps 220, 226 clear the gluing station 350. When the trailing edges of the major end flaps 220, 226 clear or are downstream of the gluing station 350, the major end flaps 220, 226 are released from the outwardly upright folded positions and, as each carton 200 continues in the flow direction F, are folded, respectively, by upper and lower static folders 410*a*, 410*b* of the folding station 400. The minor end flap retaining guide assembly 320 retains the minor end flaps 222, 224 in inwardly folded positions until the static folders 410*a*, 410*b* fold one or both of the major end flaps 220, 226 toward the minor end flaps 222, 224 to retain the minor end flaps 222, 224 in the inwardly folded positions.

Major End Flap Retaining Guide Assembly

Referring to FIGS. 1-4, each of the upper and lower major end flap retaining guide assemblies 310*a*, 310*b* includes a plurality of major end flap guides that are independently moveable and that cooperate to substantially continuously control the position of the major end flaps 220, 226 of each carton 200 as the carton 200 moves along part of the carton conveyor path X. In the exemplary embodiment, each of the upper and lower major end flap retaining guide assemblies 310*a*, 310*b* includes a longitudinally fixed major end flap guide 312, a longitudinally adjustable major end flap guide 314, and a transversely moveable major end flap guide 316. As each carton 200 moves in the flow direction F along part of the carton conveyor path X, the major end flaps 220, 226 are guided by one or more of the major end flap guides 312, 314, 316 until the trailing edges of the major end flaps 220, 226 pass the downstream ends 317 of the transversely moveable major end flap guides 316.

Figure 1:
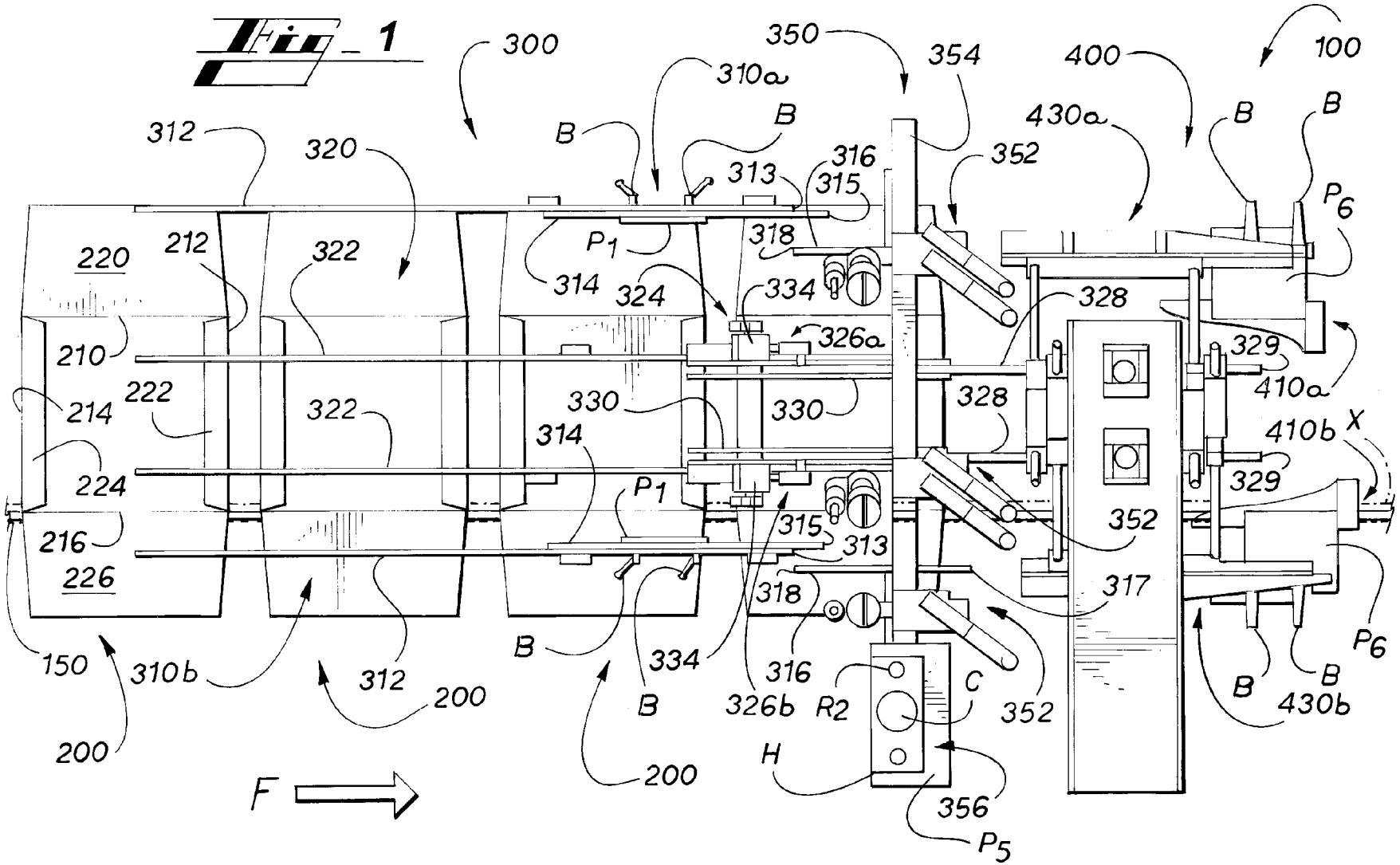
FIG. 1 is a partial operator side elevation view of a packaging machine that includes an end flap retaining guide assembly, a gluing station, and a folding station, according to a first exemplary embodiment of the present disclosure.
Figure 2:
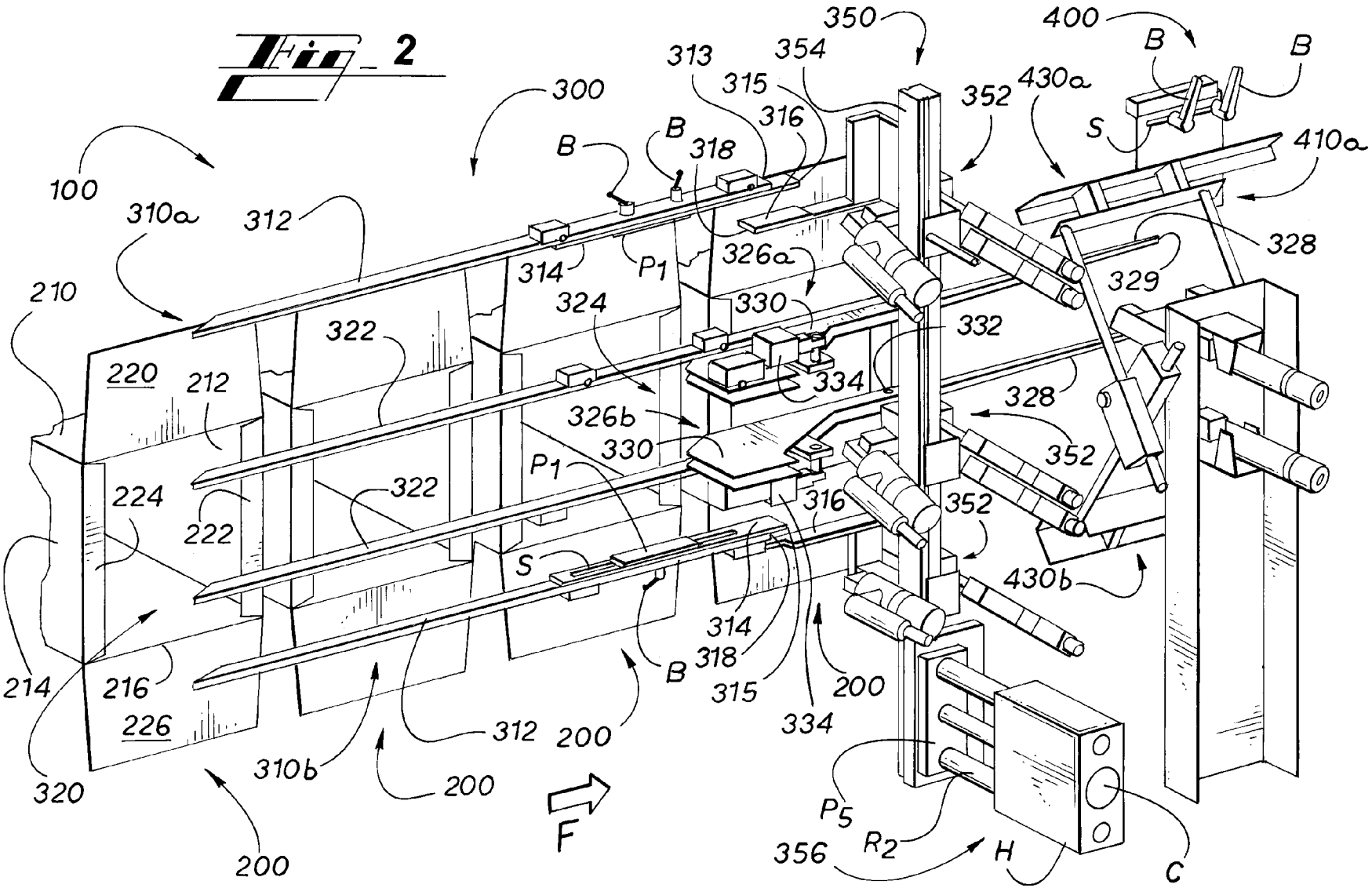
FIG. 2 is a partial operator side perspective view of the packaging machine of FIG. 1.
Figure 3:
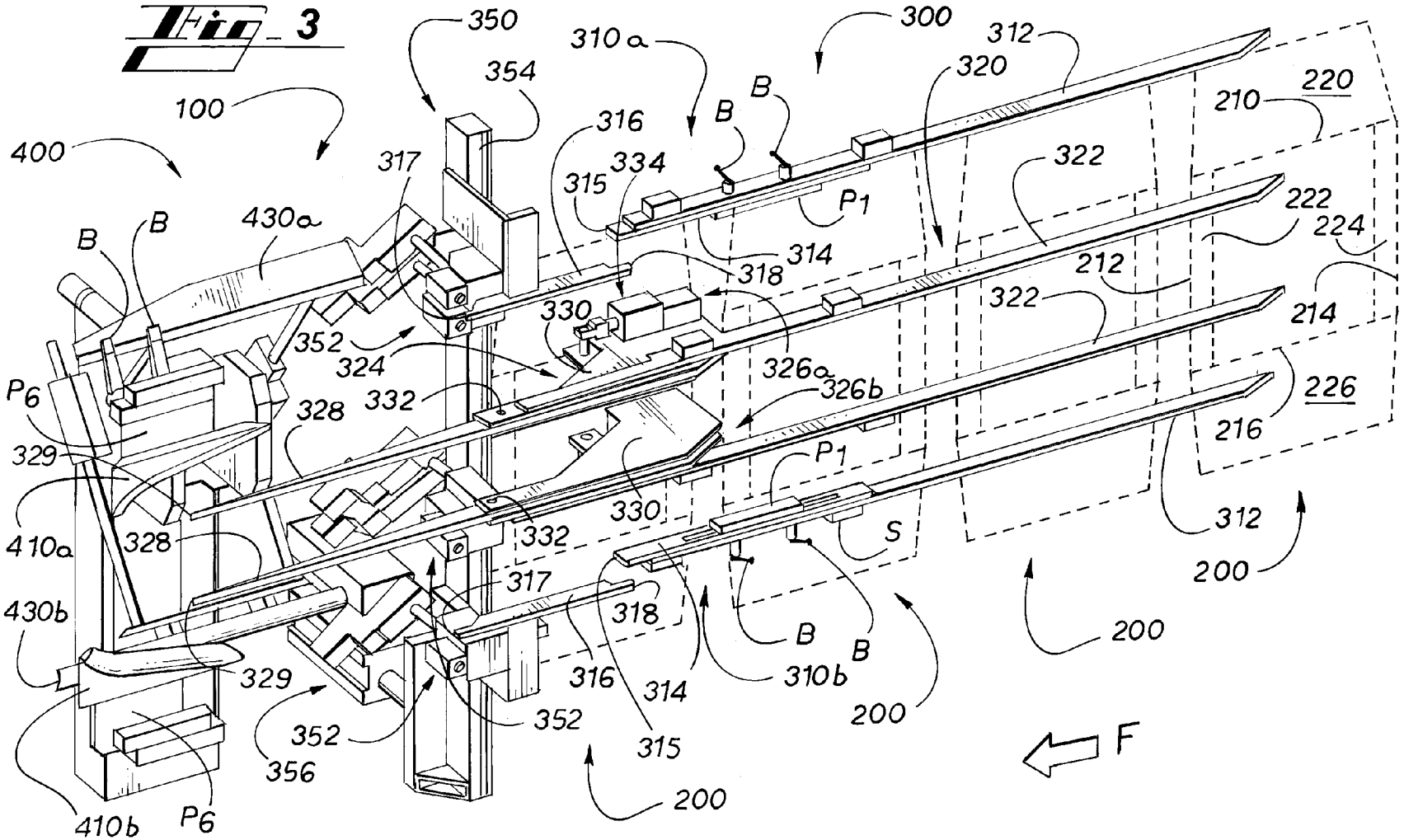
FIG. 3 is a partial carton side perspective view of the packaging machine of FIG. 1, wherein the cartons are depicted in phantom lines.

According to the first exemplary embodiment, the longitudinally adjustable major end flap guide 314 is slidably attached near the downstream end 313 of the longitudinally fixed major end flap guide 312 and the downstream ends 313, 315 of the major end flap guides 312, 314 are each positioned adjacent to the upstream end 318 of the transversely moveable major end flap guide 316. The relative positions of the major end flap guides 312, 314 can be adjustably fixed such that the downstream ends 313, 315 thereof may be selectively spaced apart from one another. As illustrated in FIGS. 1-3, the downstream end 313 of the longitudinally fixed major end flap guide 312 is substantially vertically aligned with the upstream end 318 of the transversely moveable major end flap guide 316. Further, as illustrated in FIGS. 1-3, the longitudinally adjustable major end flap guide 314 is fixed along the length of the longitudinally fixed major end flap guide 312 such that the downstream ends 313, 315 of the major end flap guides 312, 314 are vertically aligned. Referring to FIG. 8, it should be understood that the longitudinally adjustable major end flap guide 314 is fixed along the length of the longitudinally fixed major end flap guide 312 such that the downstream end 315 of the longitudinally adjustable major end flap guide 314 is downstream of the downstream end 313 of the longitudinally fixed major end flap guide 312.

Referring to FIGS. 1-3, according to the first exemplary embodiment, to slidably attach the longitudinally adjustable major end flap guide 314 to the downstream end 313 of the longitudinally fixed major end flap guide 312, the longitudinally adjustable major end flap guide 314 includes a longitudinal slot S. Tightening bolts B extend through apertures in the longitudinally fixed major end flap guide 312, through the slot S, and through apertures in a clamping plate P1. To fix the longitudinally adjustable major end flap guide 314 at a selected position such that the downstream end 315 of the longitudinally adjustable major end flap guide 314 is positioned relative to the downstream end 313 of the longitudinally fixed major end flap guide 312, the tightening bolts B are used to press the longitudinally adjustable major end flap guide 314 between the longitudinally fixed major end flap guide 312 and the clamping plate P1.

The position of the downstream end 315 of each of the longitudinally adjustable major end flap guides 314 can be adjusted during changeover to reconfigure the apparatus 100 to accommodate cartons of various widths. Further, in the exemplary embodiment, each of the transversely moveable major end flap guides 316 is a component of the gluing station 350 and moves therewith, as described in further detail below. It should be understood that, in certain embodiments, the longitudinally adjustable major end flap guide 314 can be actuated to provide the functionality of the transversely moveable major end flap guide 316 during an emergency stop. In such embodiments, the transversely moveable major end flap guide 316 can be omitted.

Figure 4:
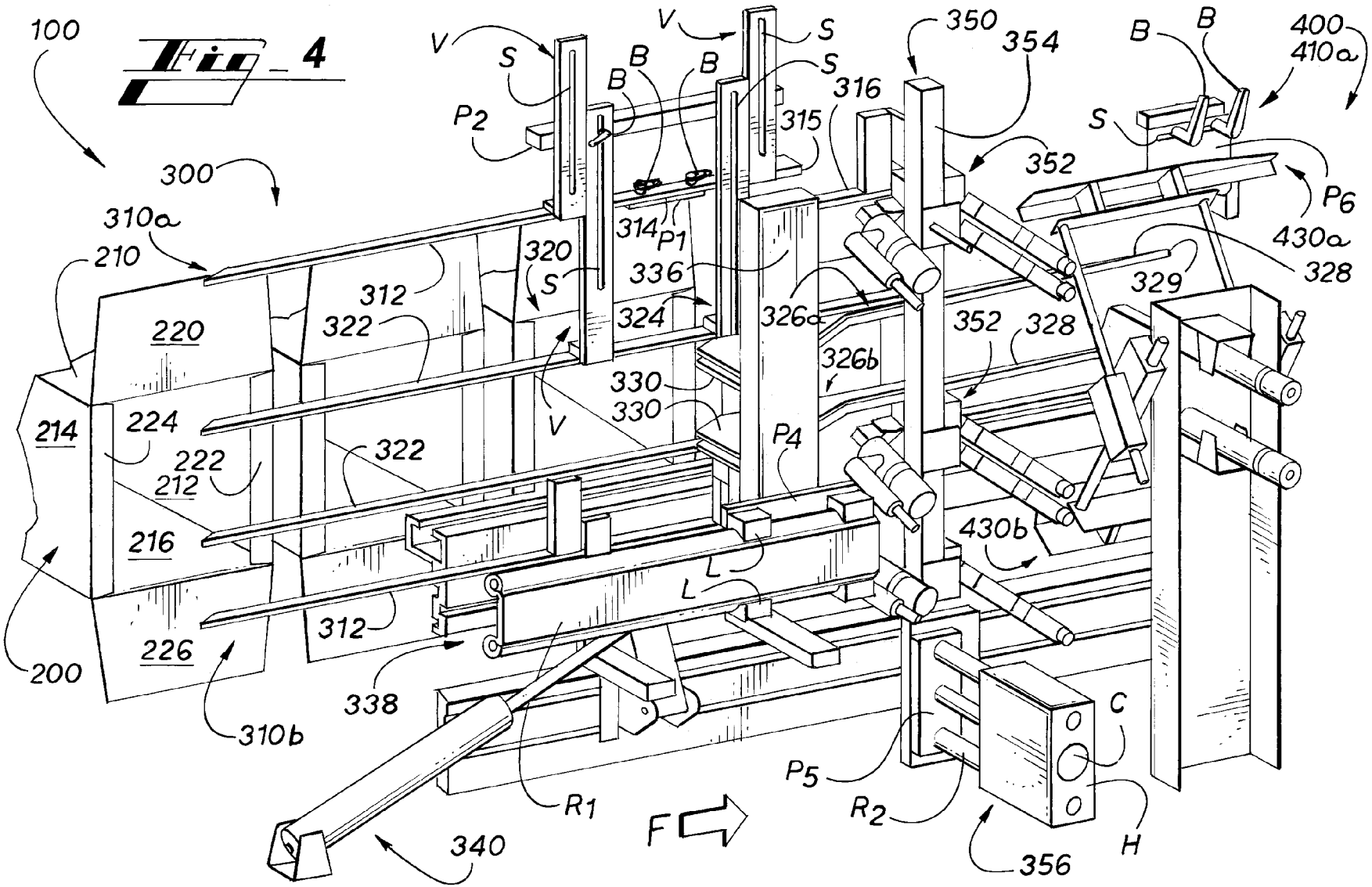
FIG. 4 is another partial operator side perspective view of the packaging machine of FIG. 1.

Each of the upper and lower major end flap retaining guide assemblies 310*a*, 310*b* is positioned to retain a respective one of the major end flaps 220, 226 in an outwardly upright or vertical position. Further, each of the major end flap guides 312, 314, 316 is vertically adjustable such that the apparatus 100 can be reconfigured to accommodate cartons of various heights. Referring to FIG. 4, exemplary means for vertically positioning includes a vertical adjustment beam V that includes a slot S is slidably attached to the frame (not shown) of the apparatus 100 and is mounted to selected vertically adjustable elements of the end flap retaining guide assembly 300. The elements can be fixed at a vertical position as the vertical adjustment beam V is pressed to a clamping plate P2 with a tightening bolt B.

Minor End Flap Retaining Guide Assembly

Figures 5, 6:
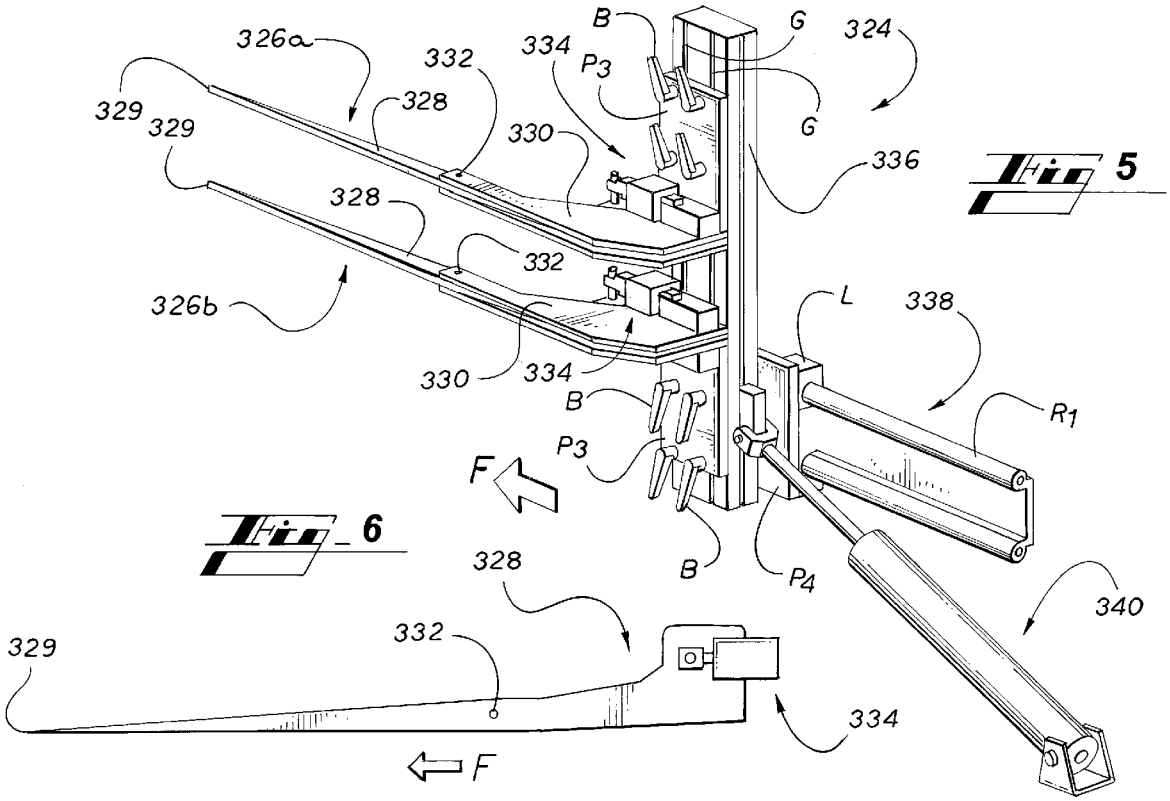
FIG. 5 is an carton side perspective view of a minor end flap unit of the end flap retaining guide assembly of FIG. 4.
FIG. 6 is a plan view of elements of the minor end flap unit in FIG. 5.

Referring to FIGS. 1-6, the minor end flap retaining guide assembly 320 includes a plurality of minor end flap guides that are independently moveable and that cooperate to substantially continuously control the position of the minor end flaps 222, 224 of each carton 200 as the cartons 200 move along part of the carton conveyor path X. In the exemplary embodiment, the minor end flap retaining guide assembly 320 includes longitudinally fixed minor end flap guides 322 (one shown in FIG. 8, two shown in FIGS. 1-4) and a minor end flap unit 324. The minor end flap unit 324, shown in FIG. 5, is positioned proximate to the downstream ends 323 of the longitudinally fixed minor end flap guides 322 and can translate longitudinally along part of the length of the carton conveyor path X.

Figure 7:
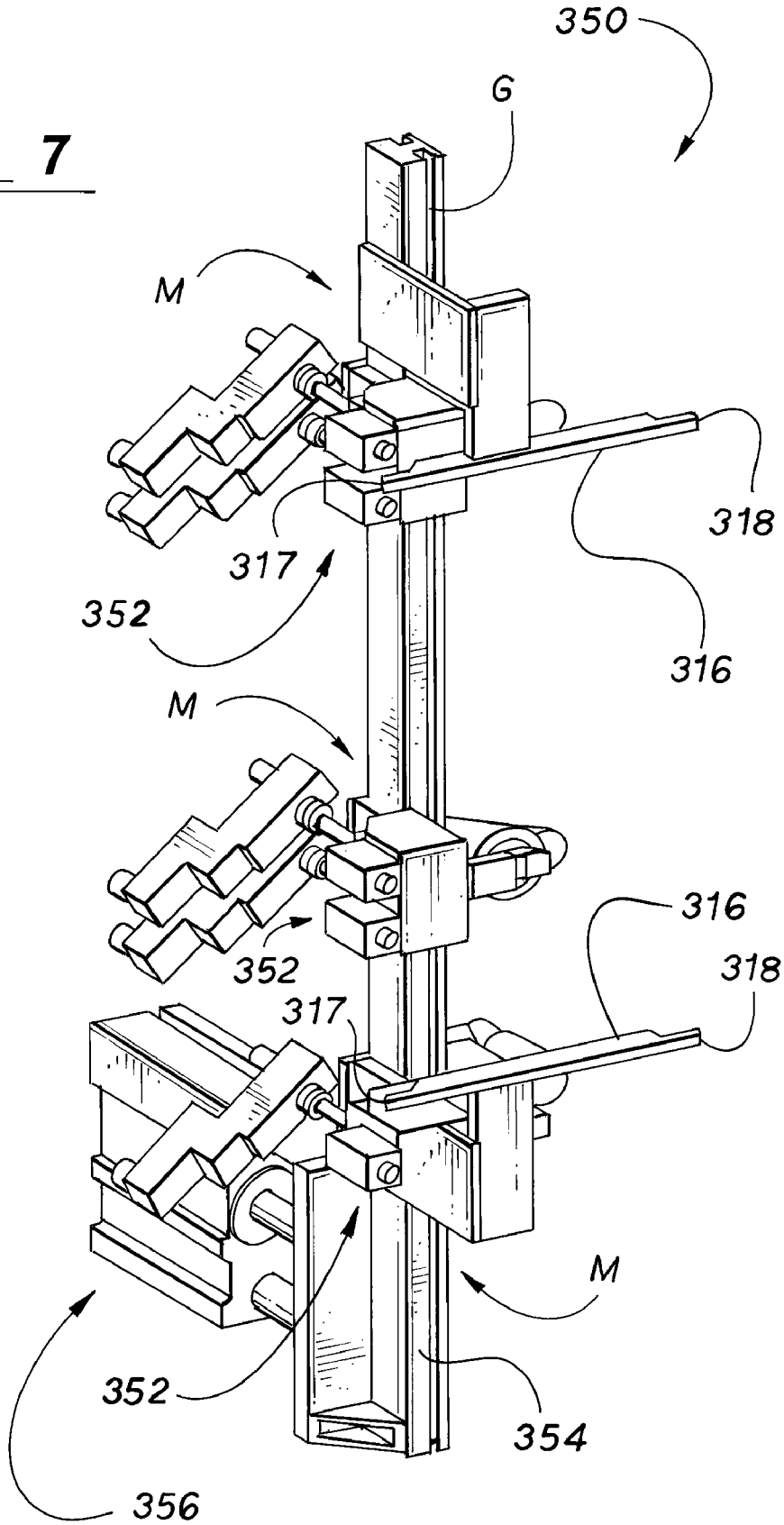
FIG. 7 is a carton side perspective view of the gluing station of FIG. 4.

Referring to FIGS. 1-3 and 5, the minor end flap unit 324 includes retractable minor end flap guides 326*a*, 326*b*. Each of the retractable minor end flap guides 326*a*, 326*b* includes a blade 328 (shown in FIG. 7) that is pivotally attached to a base guide structure 330 by a pin 332.

Referring to FIGS. 1-3, 5 and 6, the proximal end of the blade 328 is pivotally attached to a first end of a piston 334 and a second end of the piston 334 is pivotally attached to the base guide structure 330. The blade 328 is pivoted about the pin 332 by changing the length of the piston 334. Thus, in the first exemplary embodiment, the blade 328 and the piston 334 provide means for positioning the distal end 329 of the retractable minor end flap guide 326*a*, 326*b* relative to the end of an adjacent carton 200. In alternative embodiments, the retractable minor end flap guides 326*a*, 326*b* can include an arrangement of elements that function to translate the blade 328 in the transverse direction rather that pivot the blade 328 and thereby provide means for positioning.

The retractable minor end flap guides 326*a*, 326*b* are slidably attached to a first vertical member 336 or post and can be fixed at selected locations along the length of the first vertical member 336. Thus, the retractable minor end flap guides 326*a*, 326*b* are vertically adjustable, can be positioned with respect to glue guns 352, and can be reconfigured to accommodate cartons 200 of various heights. It should be noted that the longitudinally fixed minor end flap guides 322 are also vertically adjustable to accommodate cartons 200 of various heights.

The retractable minor end flap guides 326*a*, 326*b* are mounted to a mounting plate P3, tightening bolts B extend through apertures in the mounting plate P3, and ends of the tightening bolts B are configured to slide in grooves G in the first vertical member 336 such that each of the retractable minor end flap guides 326*a*, 326*b* are slidably attached to the first vertical member 336. The retractable minor end flap guides 326*a*, 326*b* can be fixed along the length of the first vertical member 336 by using the tightening bolts B to press the mounting plate P3 against the first vertical member 336.

The first vertical member 336 is attached to a first linear bearing structure 338 that is aligned with the carton conveyor path X such that the retractable minor end flap guides 326*a*, 326*b* are longitudinally moveable and/or positionable. In other words, first linear bearing structure 338 provides means for positioning the retractable minor end flap guides 326*a*, 326*b* along a path that is substantially parallel to the carton conveyor path X. The first linear bearing structure 338 includes a mounting plate P4, sliding blocks L that are mounted on one side of the mounting plate P4, and a rail structure R1 along which the sliding blocks L can slide. The first vertical member 336 is mounted to another side of the mounting plate P4 opposite the sliding blocks L. Thus, the first linear bearing structure 338 facilitates translating.

In alternative embodiments, each of means for positioning can include rollers, tracks, belts, wheels, pulleys, conveyors, chains, sprockets, pistons, actuation devices, air cylinders, grooves, combinations thereof, and the like.

Referring to FIGS. 4 and 5, in the exemplary embodiment, a piston 340 is pivotally attached to the first vertical member 336 and to the frame (not shown) of the apparatus 100. The retractable minor end flap guides 326*a*, 326*b* can be moved or positioned along the carton conveyor path X by changing the length of the piston 340. This feature is described in further detail below with respect to the operation of the apparatus 100 during a cycle stop and an e-stop.

Gluing Station Unit

Referring to FIGS. 1-4 and 7, the gluing station 350 includes a plurality of glue guns 352 that are slidably attached to a second vertical member 354 or post and that can be fixed at selected locations along the length of the second vertical member 354. Thus, the glue guns 352 can be vertically positioned to apply glue at selected locations on the end flaps of the carton 200. The glue guns 352 include a slidable mounting structure M with apertures through which tightening bolts B extend. An end of each of the tightening bolts B is attached to a groove structure or is otherwise configured to slide in a groove G of the second vertical member 354 and the tightening bolts B are used to press the slidable mounting structure M to the second vertical member 354 to fix the position of the glue guns 352 along the length of the second vertical member 354.

The transversely moveable major end flap guides 316 are also slidably attached to the second vertical member 354 and can be fixed along the length of the second vertical member 354. In certain embodiments, the transversely movable major end flap guides 316 are attached to certain of the glue guns 352.

The second vertical member 354 is attached to a second linear bearing structure 356. The second linear bearing structure 356 is aligned so as to be substantially perpendicular to the carton conveyor path X such that the gluing station 350 is transversely moveable and/or adjustable. In the exemplary embodiment, the second linear bearing structure 356 includes a mounting plate P5, rails R2 that are attached to one side of the mounting plate P5, and a housing structure H. The rails R2 can slide through and are supported by the housing structure H. The housing structure H also defines a pressure chamber for a cylinder C that is used to position the mounting plate P5. The second vertical member 354 is attached to an opposite side of the mounting plate P5. The second linear bearing structure 356 thereby facilitates translating in other words, the second linear bearing structure 356 provides means for positioning the transversely moveable major end flap guides 316 along a path that is substantially transverse to the carton conveyor path X. This feature is described in further detail below with respect to operation of the apparatus 100 during an e-stop.

Although the glue guns 352 can be vertically adjusted, the outwardly upright folding position of the major end flaps 220, 226 ensures that the major end flaps 220, 226 of cartons 200 will not come into contact with the glue guns 352 regardless of the vertical position of the glue guns 352 and regardless of the height of the cartons 200.

It should be understood that glue can be applied to the major end flaps 220, 226 and/or the minor end flaps 222, 224 and that the glue guns 352 are adjustable to control the position of any such application of glue. Further, a controller T (shown in FIG. 8) can make individual glue guns 352 inactive or active as necessary in conformance with the features and desired sealing points of the carton 200. It should be understood that glue can be applied in a manner that is consistent with a given folding sequence. For example, a bead of glue can be applied to the distal end of the bottom end flap 226 for a folding sequence where the bottom end flap 226 overlaps the top end flap 220.

Folding Station Unit

The upper and lower static folders 410*a*, 410*b* of the folding station 400 fold the major end flaps 220, 226, respectively, during steady state operation. Referring to FIGS. 1, 3 and 4, the position of the static folders 410*a*, 410*b* relative to one another along the length of the carton conveyor path X determines the major end flap 220, 226 folding sequence. For example, as illustrated in FIGS. 1, 3, and 8, the upper static folder 410*a*, which is vertically positioned to fold the top end flap 220, is positioned upstream of the lower static folder 410*b*, which is vertically positioned to fold the bottom end flap 226. Thus, the top end flap 220 of each carton 200 is folded before the bottom end flap 226 is folded and, depending on the length of each of the top and bottom end flaps 220, 226, the bottom end flap 226 can overlap the top end flap 220.

For purposes of teaching, various folding sequences are briefly described. Certain cartons are folded with a "soft-drink style" folding sequence such that the top end flap 220 overlaps the bottom end flap 226 and other cartons are folded with a "brewery style" folding sequence such that the bottom end flap 226 overlaps the top end flap 220. For cartons where the top and bottom end flaps 220, 226 do not overlap when folded, the top and bottom end flaps 220, 226 can be folded simultaneously or with either the "soft-drink style" folding sequence or the "brewery style" folding sequence.

Referring to FIGS. 1-3, the static folders 410*a*, 410*b* are longitudinally adjustable or positionable such that the folding station 400 can be reconfigured to accommodate cartons that are folded according to various folding sequences. In the exemplary embodiment, each of the static folders 410*a*, 410*b* is mounted to a mounting plate P6 that includes a slot S that is longitudinally aligned. Tightening bolts B extend through the slot S and into the frame of the apparatus 100. Thus, the slot S allows the static-folders 410*a*, 410*b* to move longitudinally and the tightening bolts B can be used to-fix the positions of the static folders 410*a*, 410*b* by pressing the mounting plate P6 against the frame of the apparatus 100.

As an example, to fold the major end flaps 220, 226 of each carton 200 according to a "soft-drink style" folding sequence, the lower static folder 410*b* is disposed upstream of the upper static folder 410*a*. To fold the major end flaps 220, 226 of each carton 200 according to a "brewery style" folding sequence, the lower static folder 410*b* is disposed downstream of the upper static folder 410*a*. To fold the major end flaps 220, 226 of each carton 200 simultaneously, the static folders 410*a*, 410*b* are positioned at the same point along the length of the carton conveyor path X. The static folders 410*a*, 410*b* are also vertically adjustable to accommodate cartons 200 of various heights.

The folding station 400 also includes pivoting folders 430*a*, 430*b* to fold the major end flaps 220, 226 of a carton 200 that have received an application of glue but have not yet been folded at the occurrence of a cycle stop or an emergency stop, as described in further detail below. The pivoting folders 430*a*, 430*b* can be independently activated and can thereby fold the top and the bottom end flaps 220, 226 according to various folding sequences. Thus, the pivoting folders 430*a*, 430*b* can be controlled and the static folders 410*a*, 410*b* can be arranged such that each folds the major end flaps 220, 226 according to the same folding sequence. It is contemplated that, in alternative embodiments, the folders 430*a*, 430*b* could be arranged such that they extend vertically rather than pivot to fold the major end flaps 220, 226.

Packaging Machine Operation

Normal operation of the apparatus 100 is steady-state operation. However, the apparatus 100 also includes features that operate during a cycle stop and/or an emergency stop (e-stop).

Steady-State Operation

The term steady state operation, as used herein, refers to apparatus 100 operation where the carton conveyor 150 is moving cartons 200 in the flow direction F past the gluing station 350 and the folding station 400 at a substantially constant speed to enable the gluing station 350 to apply glue to each passing carton 200 and to enable the static folders 410*a*, 410*b* of the folding station 400 to fold the major end flaps 220, 226.

Cycle Stop and E-Stop Operation

When the carton conveyor 150 is stopped during the packaging process, one or more cartons 200 to which glue has been applied but that have not been closed are present on the carton conveyor 150. If the carton conveyor 150 is restarted after the glue cures, these cartons 200 will be ruined because the end flaps of these cartons 200 will not be secured together as the end flaps are folded by the static folders 410*a*, 410*b*. To prevent this undesirable occurrence during the period of time that the packaging process is halted or interrupted due to a cycle stop or an e-stop, the pivoting folders 430*a*, 430*b* fold the major end flaps 220, 226 of cartons 200 to which glue has been applied, but which are yet to be folded by the static folders 410*a*, 410*b*, before the glue cures.

Cycle Stop

A controlled stop or a cycle stop, as used herein, refers to a situation where the carton conveyor 150 is stopped due to a non-emergency condition or event, such as to feed cartons or product into the apparatus 100, or to relieve an operator at the end of a shift. Thus, at cycle stop, the cartons 200 that are undergoing the packaging process can be allowed to coast or to be transported to be optimally positioned at selected positions along the length of the carton conveyor path X. For example, referring to FIG. 8, upon the occurrence of a cycle stop, the carton conveyor 150 stops as the trailing edge of each of the major end flaps 220, 226 of a certain carton 200 is downstream of the gluing station 350 and the leading edge of each of the major end flaps 220, 226 of the carton 200 is upstream of the static folders 410*a*, 410*b*. The major end flaps 220, 226 are clear of the upper and lower major end flap retaining guide assemblies 310*a*, 310*b* and are released from their outwardly upright folded positions. Further, the carton 200 is substantially aligned with the pivoting folders 430*a*, 430*b* such that the pivoting folders 430*a*, 430*b* are able to fold the major end flaps 220, 226 according to a selected folding sequence.

At this point along the length of the carton conveyor path X, the retractable minor end flap guides 326*a*, 326*b* continue to retain the minor end flaps 222, 224 in their inwardly folded positions. Since the major end flaps 220, 226 are both folded at this point along the length of the carton conveyor path X, the retractable minor end flap guides 326*a*, 326*b* are overlapped by the major end flaps 220, 226. Thus, as the pivoting folders 430*a*, 430*b* fold the major end flaps 220, 226, the retractable minor end flap guides 326*a*, 326*b* are overlapped by the major end flaps 220, 226.

The retractable minor end flap guides 326*a*, 326*b* are removed from underneath the folded major end flaps 220, 226 as the first vertical member 336 is translated upstream along the rail structure R1 of the first linear bearing structure 338 by changing the length of the piston 340.

It is possible that simply moving the minor end flap unit 324 back downstream can cause the distal ends 329 of the retractable minor end flap guides 326*a*, 326*b* to damage the carton 200. To avoid this, the minor end flap unit 324 can be returned to a steady state operating position according to one of the following two methods.

A first method includes changing the length of the piston 334 to rotate the blade 328 such that the distal end 329 of the blade 328 is offset from the end of the adjacent carton 200. The first vertical member 336 can then be moved downstream to the steady state operating position and, thereafter, the length of piston 334 is changed to return the blade 328 to its unpivoted or steady state running position.

A second method includes moving the first vertical member 336 and retractable minor end flap guides 326*a*, 326*b* downstream at the same speed as the carton conveyor 150, when the carton conveyor 150 is restarted, until the minor end flap unit 324 returns to a steady state operating position. One means for synchronizing the movement of the retractable minor end flap guides 326*a*, 326*b* and the carton conveyor 150 can include creating a temporary mechanical engagement between the minor end flap unit 324 and the carton 200 or carton carrier chain lugs. Alternatively, a separate synchronized motor drive can control the length of the piston 340 and provide means for synchronizing.

Emergency Stop

Figure 9:
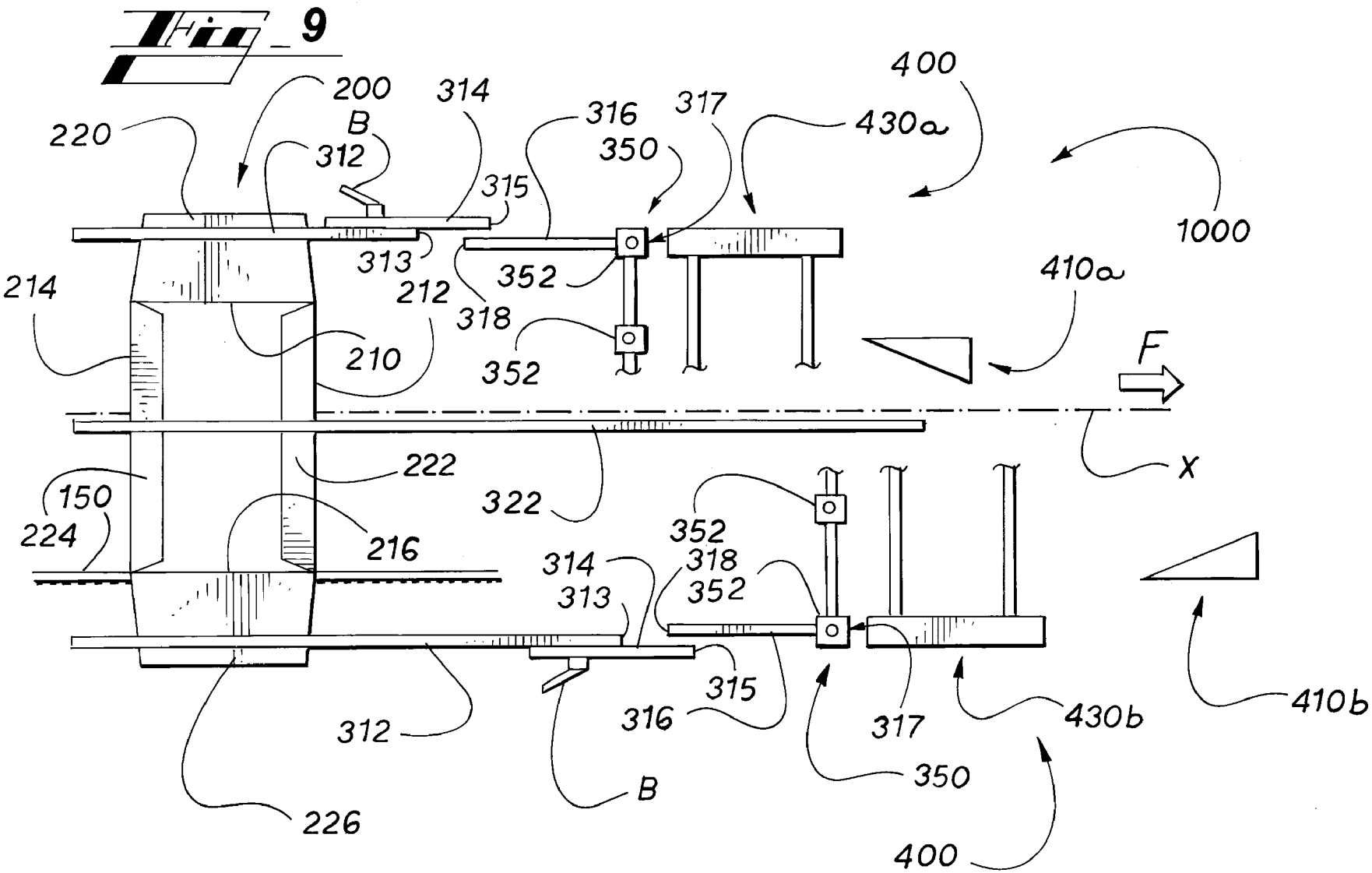
FIG. 9 is a partial operator side elevation view of a packaging machine that includes gluing stations and folding stations, according to a second exemplary embodiment of the present disclosure.

An uncontrolled stop or emergency stop (e-stop), as used herein, refers to a situation where the carton conveyor 150 is stopped at a random time to avoid injury or damage. Thus, at e-stop it is typically desirable to abruptly stop the packaging process such that cartons 200 are positioned at random positions along the length of the carton conveyor path X. Referring to FIG. 9, during an emergency stop, the carton conveyor 150 may stop as the trailing edge of each of the major end flaps 220, 226 of a certain carton 200 is upstream of the gluing station 350 and the leading edge of each of the major end flaps 220, 226 of the carton 200 is downstream of the gluing station 350. The major end flaps 220, 226 are retained in their outwardly upright folded positions by the transversely moveable major end flap guides 316. It should be noted that the longitudinally adjustable major end flap guides 314 are adjusted such that the trailing edge of each of the major end flaps 220, 226 is downstream of the downstream end 315 of the respective longitudinally adjustable major end flap guide 314. For example, the longitudinal distance between the downstream end 317 of each of the transversely moveable major end flap guides 316 (or the glue guns 352) and the downstream end 315 of a respective one of the longitudinally adjustable major end flap guides 314 is substantially equal to the widths of the respective major end flaps 220, 226 or otherwise the widths of the cartons 200.

To allow the pivoting folders 430*a*, 430*b* to fold the major end flaps 220, 226 of a certain carton 200 during an emergency stop, the transversely moveable major end flap guides 316 and the gluing station 350 are moved by the second linear bearing structure 356 transversely away from the carton 200 such that the major end flaps 220, 226 are released from their outwardly upright folded positions. The portions of the major end flaps 220, 226 that are downstream of the gluing station 350 can have glue applied thereto and these portions are substantially aligned with the pivoting folders 430*a*, 430*b* such that the pivoting folders 430*a*, 430*b* are able to fold the major end flaps 220, 226. Thus, although glue has not been fully applied to the entire length of the major end flaps 220, 226 (and/or the minor end flaps 222, 224), the major end flaps 220, 226 can be folded and secured to one another such that the carton 200 is suitably constructed to continue through the apparatus 100 when the apparatus 100 is restarted. In other words, the major end flaps 220, 226 are at least tacked down to prevent them being sheared off or torn once the packaging process resumes. The pivoting folders 430*a*, 430*b* also complete the construction of a carton 200 that is adjacent and downstream of the partially glued carton 200 if the conveyor is stopped such that the major end flaps 220, 226 of the adjacent and downstream carton 200 are only partially folded by the static folders 410*a*, 410*b*.

Double Gluing Station Arrangement

Referring to FIG. 9, another exemplary embodiment of an apparatus 1000 includes first and second gluing stations and first and second folding stations. This arrangement enables utilization of a single folding process. It should be understood that the arrangement of the elements of the apparatus 1000 requires a longer carton conveyor path to accomplish the gluing and folding procedures. Further, the minor end flap unit is omitted in this embodiment. It should be understood that, since the end flaps are folded at different points along the length of the carton conveyor path, the minor end flap guides can be positioned to retain the minor end flaps while one of the major end flaps is folded without being overlapped by the other major end flap. In the present embodiment, the top end flap is folded first and the minor end flap guide is positioned to contact a lower portion of each of the minor end flaps.

The above-described embodiments are merely exemplary illustrations of implementations set forth for a clear understanding of the principles of the invention. Variations, modifications, and combinations may be made to the above-described embodiments without departing from the scope of the claims. For example, rather than the carriage and rail elements, the translational coupling may include a roller and slot arrangement. Orientational terms such as vertical or horizontal are intended to facilitate understanding of the invention in a relative sense, and not to limit the invention to the orientation shown in the figures. In other words, although the exemplary carton conveyor path runs along the horizontal plane, it is contemplated that all or part of the carton conveyor path may run at an angle with respect to the horizon. All such variations, modifications, and combinations are included herein by the scope of this disclosure and the following claims.

What is claimed is:

1. An apparatus for forming an end closure structure of a tubular carton that travels in a flow direction along a carton conveyor path, the end closure structure being formed from at least a minor end flap and a major end flap, the apparatus comprising:

a major end flap retaining guide assembly for retaining the major end flap in an outwardly upright position, said major end flap retaining guide assembly comprising a transversely moveable major end flap guide;

a minor end flap retaining guide assembly for retaining the minor end flap in an inwardly folded position; and a gluing station for applying adhesive to at least one of the major and minor end flaps, the gluing station comprising:

a vertical support member; and at least one glue gun that is positionable along the length of the vertical support member.

2. The apparatus of claim 1, wherein the at least one glue gun is positionable above a top wall of the tubular carton.

3. The apparatus of claim 1, wherein the at least one glue gun is positionable below a bottom wall of the tubular carton.

4. The apparatus of claim 1, further comprising a controller for activating or deactivating said at least one glue gun according to a selected folding sequence.

5. The apparatus of claim 1 wherein said major end flap retaining guide assembly further comprises a longitudinally fixed major end flap guide and a longitudinally adjustable major end flap guide.

6. The apparatus of claim 1 wherein said transversely movable major end flap guide is slidably attached to said vertical support member.

7. The apparatus of claim 1 comprising an upper major end flap retaining guide assembly and a lower major end flap retaining guide assembly.

* * * * *